US005352114A

United States Patent [19]

Numoto et al.

[11] Patent Number: 5,352,114

[45] Date of Patent: Oct. 4, 1994

[54] CATALYTIC BURNING APPARATUS AND CATALYTIC BURNING METHOD

[75] Inventors: Hironao Numoto, Ikoma; Tetsuo Terashima, Neyagawa, both of Japan

[73] Assignee: Matsushita Electric Industrial Co., Ltd., Osaka, Japan

[21] Appl. No.: 73,892

[22] Filed: Jun. 9, 1993

[30] Foreign Application Priority Data

Jun. 9, 1992 [JP] Japan ..... 4-149160

[51] Int. Cl.[5] ..... F23D 14/12

[52] U.S. Cl. ..... 431/7; 431/328

[58] Field of Search ..... 431/328, 329, 7

[56] References Cited

U.S. PATENT DOCUMENTS

| | | | |
|---|---|---|---|
| 3,810,732 | 5/1974 | Koch | 431/7 |
| 3,954,387 | 5/1976 | Cooper | 431/329 |
| 4,154,568 | 5/1979 | Kendall | 431/328 |
| 4,397,356 | 8/1983 | Retallick | 431/7 |
| 5,158,448 | 10/1992 | Kawasaki et al. . | |
| 5,228,847 | 7/1993 | Lywood et al. | 431/7 |

*Primary Examiner*—Carroll B. Dority
*Attorney, Agent, or Firm*—Ratner & Prestia

[57] ABSTRACT

A catalytic burning apparatus includes a mixed gas generator, a air blow fan, a subsidiary catalyst layer, a main catalyst layer, and exhaust openings. The main catalyst layer has a larger thermal capacity than that of the subsidiary catalyst layer and the mixed gas generator, the main catalyst layer, and the exhaust openings are disposed along the flow of premixed gas.

32 Claims, 3 Drawing Sheets

CATALYTIC BURNING APPARATUS AND CATALYTIC BURNING METHOD

BACKGROUND OF THE INVENTION

The present invention relates to a catalytic burning apparatus for effecting oxidizing reactions of liquid or gaseous fuel on a solid oxidizing catalyst, and also to a method of catalytic burning.

In a catalytic burning apparatus and a catalytic burning method, after mixing the air with liquid or gaseous fuel, this mixed gas is catalytically oxidized by a catalyst. Flameless catalytic burning then occurs. Heretofore, a catalytic burning apparatus using gas which is produced by mixing air with gaseous fuel have been proposed. The above described conventional catalytic burning apparatus is described in U.S. Pat. No. 5,158,448 which is incorporated herein by reference and explained with reference to FIG. 3.

FIG. 3 shows a conventional catalytic burning apparatus. In FIG. 3 a mixing room 12 is used for mixing fuel with air. Flame ports 13 are disposed downstream along with the flow of premixed gas of the mixing room 12. An ignition plug 15 and a flame rod 16 are disposed near the flame ports 13, and a catalyst layer 14 is disposed downstream along the flow of premixed gas of the flame ports 13. The catalyst layer 14 has a plurality of communicating holes 14*a*. The operation of the apparatus is carried out by the following steps.

(1) A step of activating the ignition plug 15 for forming a flame at the flame ports 13.

(2) A step of extinguishing the flame after a lapse of a predetermined time length by stopping the fuel supply, and (3) A step of starting a catalytic burning reaction on the surface of the catalyst layer 14 by supplying fuel again without activating the ignition plug 15.

The operation is controlled in such manner that, in the flame forming step at the flame ports 13, the burning is stopped when the flame rod 16 as an ion current detecting means does not detect a predetermined electric current. In the catalytic burning step at the catalyst layer 14, the burning is stopped, in contrast with the above, when the flame rod 16 detects the predetermined electric current.

However, the above described catalytic burning apparatus has the following disadvantages. First, to adjust the temperature of the room, the catalytic burning must be turned on and off which creates an offensive smell. Second, when using the above described apparatus for heating, there is little allowance for the room capacity, since heating power is determined by the size of the catalytic layer.

SUMMARY OF THE INVENTION

The present invention relates to a catalytic burning apparatus which includes a main catalyst layer and a subsidiary catalyst layer. The main catalyst layer has larger thermal capacity than that of the subsidiary catalyst layer and is disposed downstream of the subsidiary catalyst layer along the flow of premixed gas.

In one exemplary embodiment, the thickness of the main catalyst layer and the subsidiary catalyst layer measured along the flow of premixed gas and the distance between the main catalyst layer and the subsidiary catalyst layer are separated in such manner that the main catalyst layer is used mainly for strong burning and the subsidiary layer is used mainly for weak burning.

The present invention also provides a catalytic burning apparatus which includes a mixed gas generator, an air blow fan, a subsidiary catalyst layer, a main catalytic layer, and exhaust openings. The main catalyst layer has larger thermal capacity than that of the subsidiary catalyst layer and the mixed gas generator. The mixed gas generator, main catalyst layer, and exhaust openings are disposed along the flow of premixed gas in this order.

In one exemplary embodiment, the distance between the main catalyst layer and the subsidiary catalyst layer, and the thickness of the main catalyst layer and the subsidiary catalyst layer placed along the flow of premixed gas are arranged in such a manner so that the main catalyst layer is used mainly for strong burning and the subsidiary catalyst layer is used mainly for weak burning.

The present invention further relates to a catalytic burning apparatus which includes a mixed gas generator, an air blow fan, a subsidiary catalyst layer, a main catalytic layer, a deodorizing catalyst layer, and exhaust openings. The main catalyst layer has a larger thermal capacity than that of the subsidiary catalyst layer, and the mixed gas generator. The mixed gas generator, main catalyst layer deodorizing catalyst layer, and exhaust opening are disposed along the flow of premixed gas in this order.

In another exemplary embodiment, the thickness of the main catalyst layer and the subsidiary catalyst layer placed along the flow of premixed gas and the main catalyst layer and the subsidiary catalyst layer are separated so that the main catalyst layer is used mainly for strong burning and the subsidiary catalyst layer is used mainly for weak burning.

Still further, the present invention relates to a catalytic burning method which includes the steps of preheating the subsidiary catalyst layer by blowing the premixed gas on the subsidiary catalyst layer and the step of causing weak catalytic burning and then increasing the blowing speed of the premixed gas to cause strong catalytic burning on the main catalyst layer.

Furthermore, the present invention relates to a catalytic burning method which includes the steps of selecting the blowing speed of a mixed gas, and selecting a particular catalytic layer for burning based on the selected blowing speed of the premixed gas.

According to the present invention, the following advantages can be obtained:

(1) A catalytic burning apparatus and a catalytic burning method are disclosed by which room temperature can be adjusted according to its capacity in wide range.

(2) A catalytic burning apparatus and a catalytic burning method are disclosed by which a room can be heated with little offensive smell.

(3) A catalytic burning apparatus and a catalytic burning method are disclosed by which room temperature can be maintained at a pre-determined level with small fluctuation.

DETAILED DESCRIPTION OF THE PREFERRED EMBODIMENTS

Figure 1:
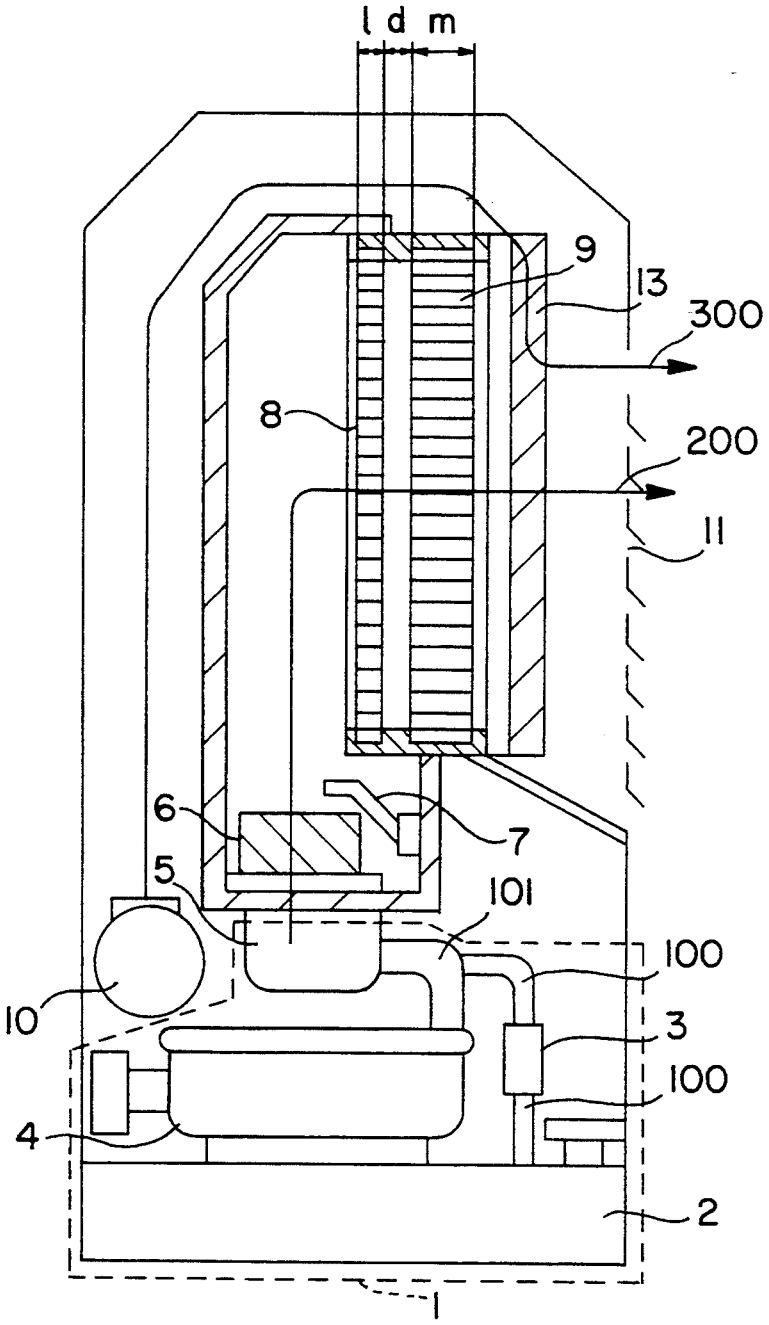
FIG. 1 shows a structural side view of a catalytic burning apparatus of the present invention.

Exemplary embodiments of the present invention are now described. FIG. 1 shows a catalytic burning apparatus as one exemplary embodiment of the present invention. In FIG. 1, mixed gas generator 1 includes a liquid fuel tank 2, a fuel pump 3, an air blow fan 4, and a mixing room 5. The liquid fuel tank 2 is connected to mixing room 5 through fuel pump 3 and a pipe 100. The air blow fan 4 is also connected to mixing room 5 through a pipe 101.

By use of fuel pump 2 and air blow fan 4, liquid fuel in liquid fuel tank 2 is first evaporated and is then mixed with air in mixing room 5 so that premixed gas is produced. This premixed gas is conveyed to flame ports 6 which are disposed downstream along the flow of premixed gas of the mixing room 5. Arrow 200 denotes the flow of premixed gas. Further structures are explained with regard to the operation of the catalytic burning apparatus.

In FIG. 1, (l), (m) show thickness of the subsidiary catalyst layer 8 and main catalyst layer 9 measured along the flow of premixed gas respectively, (see arrow 200) and d shows a gap or distance between the subsidiary catalyst layer 8 and main catalyst layer 9.

First, the premixed gas is ignited at the flame ports 6 by an ignition plug 7. Thereby, flame burning is started. Exhaust gas of high temperature flows upwards and heats the subsidiary catalyst layer 8.

After the temperature of the subsidiary catalyst layer 8 reaches a sufficiently high temperature (about 350° C.), the operation of the mixed gas generator 1 is stopped once to put out the flame on the flame ports 6. Then, mixed gas is provided to the subsidiary catalyst layer 8, and effects catalytic burning which occurs mainly at the upstream side surface of subsidiary catalyst layer 8, since the subsidiary catalyst layer 8 has been sufficiently heated. Burned exhaust gas flows to the main catalyst layer 9 which is located downstream of the subsidiary catalyst layer 8, and heats up the main catalyst layer 9. After weak catalytic burning is carried out at the subsidiary catalyst layer 8 for a predetermined time, the velocity of the flow of premixed gas is increased.

The main catalyst layer 9 is disposed downstream of the subsidiary catalyst layer 8, along the flow of premixed gas and reheated by radiational and convectional heat from catalytic burning generated at the subsidiary catalyst layer 8. This is more efficient than simply using the flame of the flame ports 6 for heating the main catalyst layer 9. The subsidiary catalyst layer 8 works as a flat panel heater.

The main catalyst layer 9 is sufficiently heated, and the velocity of the flow of premixed gas is too fast to cause the catalytic burning on the subsidiary catalyst layer 8. Catalytic burning is then carried out at the main catalytic layer 9. The thickness (l) of the subsidiary catalyst layer 8 measured along the flow of premixed gas is too thin to cause a catalytic burning by given velocity of the flow of the premixed gas. The main catalytic layer 9 has enough thickness (m) measured along the flow of premixed gas to maintain catalytic burning by itself by the given velocity of the flow of the premixed gas.

Thereby, shifting catalytic burning from subsidiary catalytic layer 8 to the main catalytic layer 9 is completed, and the burning is gradually strengthened. Then, a convectional ventilating fan 10 is started. The heat of the main catalyst layer 9 is radiated for maintaining an adequate temperature for catalytic burning. An arrow 300 denotes the air flow caused by the convectional ventilating fan 10. The air flow caused by the convectional ventilating fan 10 is adjusted according to the strength of the burning. The convectional ventilating fan 10 makes it possible to increase the level of the catalytic burning. If the velocity of the flow of the premixed gas is made slower so that the catalytic burning at the subsidiary catalytic layer 8 is initiated again, the catalytic burning is mainly generated at the subsidiary catalytic layer 8. Because the subsidiary catalytic layer 8 has small heat capacity and heat conductivity, the heat of the burning stays in the subsidiary catalyst layer 8 and it is possible to maintain the temperature of the subsidiary catalyst layer 8 high. Furthermore, since the thickness (l) measured along the flow of premixed gas is thin, outgoing radiant heat is comparatively small. This leads to efficient burning compared with only using the main catalyst layer 9 for weak burning. In the case of strong burning at the main catalyst layer 9, the subsidiary catalyst layer 8 needs to be heated to a sufficient temperature to maintain the activity, and vice versa. From this view point, it is required that the distance (d) between the subsidiary catalyst layer 8 and the main catalyst layer 9 must not exceed a certain length (about 20 mm). The exhausted gas is decreased in temperature by the convectional ventilating fan 10, and ventilated as mild current from the exhaust openings 11. The surface temperature of this catalytic burning apparatus is also cooled down by the convectional ventilating fan 10.

EXAMPLE 1

First, a corrugated structure ceramic is prepared which is made from alumina-silica fiber (155 mm×155 mm, 3 mm thick, 200 cell/inch$^2$; 0.30 mm thick rib). Then, a washcoating slurry is prepared which contains $BaO{\cdot}Al_2O_3{\cdot}CeO_2$ powder (a specific area is 120 m$^2$/g) of 1000 g, 10 wt percent alumina of 50 g which contains a washcoating binder, aluminum nitrate nonahydrate of 85 g, water of 1500 g, isopropyl alcohol of 150 g, aqueous solution of dinitrodiamine platinum in an amount which corresponds to 5 g of platinum, and aqueous solution of dinitrodiamine paladium in an amount which corresponds to 5 g of paladium. Immersing the above-mentioned corrugated structure ceramic in this washcoating slurry and drying it, it is coated by washcoating slurry of 10 g. The subsidiary catalyst layer 8 is thus formed.

Second, a honeycomb ceramic is prepared in which silica, alumina, titania are primary components (155mm×155 mm, 15mm thick, 400 cell/inch$^2$, 0.15 mm thick rib).

Then, a washcoating slurry is prepared which contains $BaO{\cdot}Al_2O_3{\cdot}CeO_2$ (a specific surface area is 120 m$^2$/g) of 1000 g, 10 wt percent containing washcoating binder of 50 g, aluminum nitrate nonahydrate of 85 g, water of 1300 g, aqueous solution of dinitrodiamine platinum in an amount which corresponds to 5 g of platinum, and aqueous solution of dinitrodiamine paladium in an amount which corresponds to 5 g of paladium. The steps of immersing the above-mentioned corrugated structure ceramic in this washcoating slurry and then drying it are performed until a 10 g coating of the 10 g washcoating slurry is formed. Thereby, the main catalyst layer 9 is formed. The catalytic burning apparatus is assembled as shown in FIG. 1 using the above mentioned subsidiary catalyst layer 8 and main catalyst layer 9. The distance (d) between the subsidiary catalyst layer 8 and main catalyst layer 9 is 1 cm. The catalytic burning using kerosene was carried out on surfaces 150×150 square mm of the main catalyst layer 9 and the subsidiary catalyst layer 8. The characteristic of the burning ($HC,CO,CO_2$) was then measured. As a comparative example, the catalytic burning apparatus which only uses the main catalyst layer for burning was carried out and the characteristic of the burning was measured.

Figure 2:
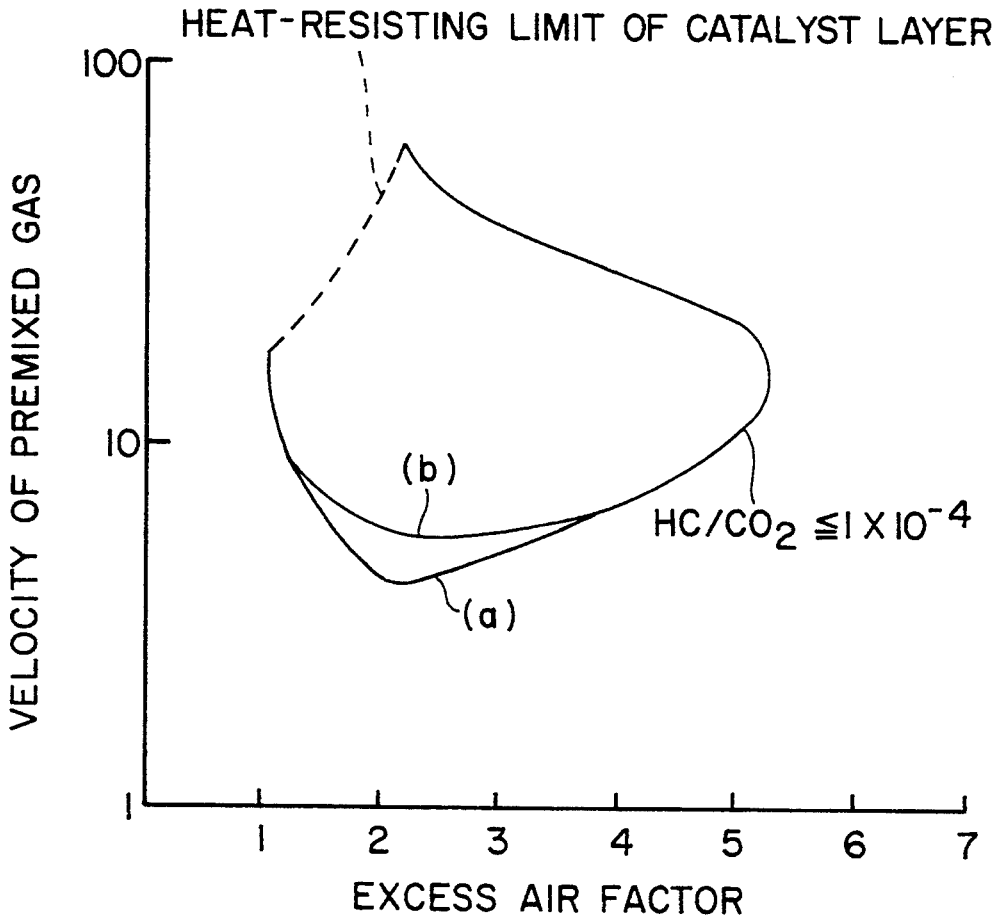
FIG. 2 is a graph showing burning characteristics of prior art and present invention.

FIG. 2 shows a graph in which the horizontal axis is the excess air factor, and the vertical axis is the velocity of premixed gas. The domain of the graph indicates that the ratio of the volume of the exhaust gas HC to $CO_2$ is within $1\times10^{-4}$. In FIG. 2, (a),(b) shows characteristic of the burning in the exemplary embodiment and the comparative example, respectively.

The domain in which the ratio of the volume of exhaust gas, CO to $CO_2$ has a larger area than that of HC to $CO_2$ suggests less toxicity. The ratio of the volume of the exhausted gas, HC to $CO_2$ and CO to $CO_2$ suggests the ratio of imperfect burning to perfect burning, As a result, in the exemplary embodiment, the value of the characteristic of catalytic burning is improved in weak burning when compared with the comparative example. This is because the maintained temperature of subsidiary catalyst layer 8, especially upstream of it, is higher than that of the comparative example. Therefore, in the exemplary embodiment it is possible to set up a smaller minimum burning rate than that of the prior art, and a catalytic burning apparatus which has a larger strong burning rate to weak burning rate ratio is obtained.

The interval from the time when activating the ignition plug 7 for forming a flame at the flame ports to the time when the surface of the upstream side of the catalyst layer reaches to 350° C. is 15 seconds less than that of the comparative example.

In the exemplary embodiment, a corrugated structure ceramic of 50 percent porosity is used, but it is possible to shorten the interval by use of a ceramic which has a larger value of porosity.

Next, the distance between the main catalyst layer 9 and the subsidiary catalyst layer 8 is analyzed. The condition of the burning of the catalyst burning apparatus is that the excess air factors are 2.0, 2.5, 3.0 where the superior characteristic of burning is achieved. After setting up these values, the velocity of flow of premixed gas is adjusted to shift from the strong catalytic burning to weak catalytic burning. In the following table, a 0 denotes the distances between the subsidiary catalyst layer and the main catalyst layer where the transfer of the catalytic burning to the subsidiary catalyst layer is realized, and X denotes where the transfer of the catalytic burning to the subsidiary catalyst layer 8 is not realized.

| distance between subsidiary catalyst layer and main catalyst layer | excess air factor | | |
|---|---|---|---|
| | 2.0 | 2.5 | 3.0 |
| 5 mm | 0 | 0 | 0 |
| 10 mm | 0 | 0 | 0 |
| 15 mm | 0 | 0 | X |
| 20 mm | 0 | X | X |

-continued

| distance between subsidiary catalyst layer and main catalyst layer | excess air factor | | |
|---|---|---|---|
| | 2.0 | 2.5 | 3.0 |
| 25 mm | X | X | X |

From the above results, it is suggested that the most favorable distance between the main catalyst layer 9 and the subsidiary catalyst layer 8 is within 20 mm at an excess air factor of 2.0. At higher values of the excess air factor, the transferring of the catalytic burning to the subsidiary catalyst layer 8 is unlikely to occur except at shorter distances. There is a tendency that for the larger value of the excess air factor, the reaction heat generated on the main catalyst layer 9 does not return to the subsidiary catalyst layer 8.

In an exemplary embodiment, the corrugated structure ceramic is made from alumina-silica fiber of 50 percent porosity for the subsidiary catalyst layer. It is desirable to use heat-resistant inorganic fiber of 50 to 80 percent porosity as a substrate such as alumina-silica fiber and so on. When the porosity is under 50 percent, there is little difference from ordinary ceramics, and when the porosity is above 80 percent, it is difficult to obtain a sufficient mechanical strength. Furthermore, the desirable configuration of the substrate has communicating holes provided by a honeycomb structure or a corrugated structure.

The thickness of the subsidiary catalyst layer measured along the flow of premixed gas is set up in order to achieve weak burning only on the subsidiary catalyst layer 8, and between the medium and strong burning mainly on the main catalyst layer 9. For this fixation, the thickness measured along the flow of premixed gas is required to institute 2~4 mm when the cell density of the communicating holes is 200 cells/inch$^2$. This thickness is fairly small.

It is desirable to use a thinner thickness when the cell density is higher. For a subsidiary catalyst layer 8 of low density, the large porosity is desirable to prevent the temperature from decreasing to the upstream side temperature of the subsidiary catalyst layer 8.

Figure 3:
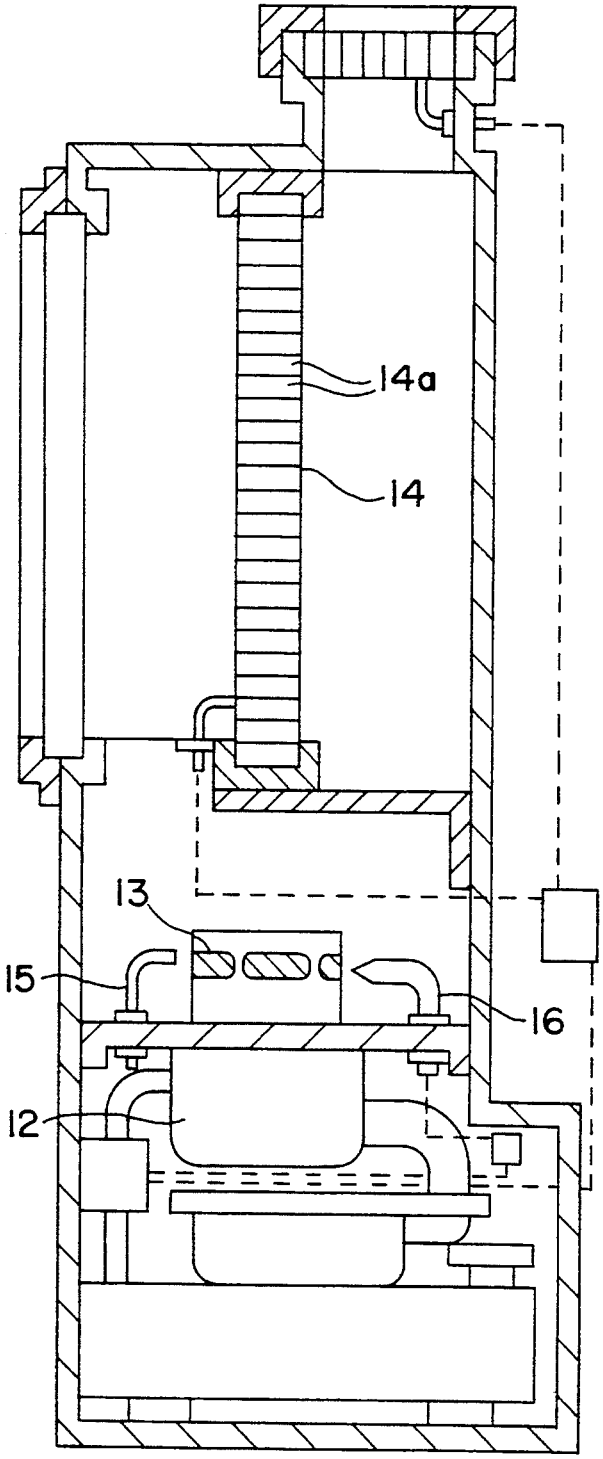
FIG. 3 PRIOR ART
FIG. 3 shows a structural side view of a conventional catalytic burning apparatus.

A catalyst layer for deodorizing is described in U.S. Pat. No. 5,158,448 which is incorporated herein by reference. In the exemplary embodiment illustrated in FIG. 3, a deodorizing catalyst layer 13 is available downstream, along the flow premixed gas from main catalyst layer 9, and an offensive smell is thereby removed.

What is claimed:

1. A catalytic burning apparatus comprising:

a main catalyst layer for catalytic burning, and a subsidiary catalyst layer for catalytic burning, wherein said main catalyst layer has a larger thermal capacity than that of said subsidiary catalyst layer and is disposed along a flow of premixed gas in a downstream direction from said subsidiary catalyst layer; and said main catalyst layer and said subsidiary catalyst layer define a gap along said flow of premixed gas, said gap, said main catalyst layer, and said subsidiary catalyst layer being so arranged that a thickness of said main catalyst layer is used substantially for strong catalytic burning and a thickness of said subsidiary catalyst layer is used substantially for weak catalytic burning.

2. A catalytic burning apparatus comprising:

a mixed gas generator for mixing fuel with air,
an air blow fan,
a subsidiary catalyst layer for catalytic burning,
a main catalyst layer for catalytic burning, and
exhaust openings,
wherein said main catalyst layer has a larger thermal capacity than said subsidiary catalyst layer and said mixed gas generator,
said mixed gas generator, said subsidiary catalyst layer, said main catalyst layer, and said exhaust openings are disposed along a flow of premixed gas in that order; and
said main catalyst layer and said subsidiary catalyst layer define a gap along said flow of premixed gas, said gap, said main catalyst layer, and said subsidiary catalyst layer being so arranged that a thickness of said main catalyst layer is used substantially for strong catalytic burning and a thickness of said subsidiary catalyst layer is used substantially for weak catalytic burning.

3. A catalytic burning apparatus comprising:
a mixed gas generator for mixing fuel with air,
an air blow fan,
a subsidiary catalyst layer for catalytic burning,
a main catalyst layer for catalytic burning,
a deodorizing catalyst layer for removing offensive smell, and
exhaust openings,
wherein said main catalyst layer has larger thermal capacity than said subsidiary catalyst layer and said mixed gas generator,
said mixed gas generator, said subsidiary catalyst layer, said main catalyst layer, said deodorizing catalyst layer, and said exhaust openings are disposed along a flow of premixed gas in that order; and
said main catalyst layer and said subsidiary catalyst layer define a gap along said flow of premixed gas, said gap, said main catalyst layer, and said subsidiary catalyst layer being so arranged that a thickness of said main catalyst layer is used substantially for strong catalytic burning and a thickness of said subsidiary catalyst layer is used substantially for weak catalytic burning.

4. A catalytic burning apparatus comprising:
a mixed gas generator for mixing fuel with air,
an air blow fan,
a subsidiary catalyst layer for catalytic burning,
a main catalyst layer for catalytic burning,
exhaust openings, and
a heating means for preheating the subsidiary catalyst layer,
wherein said main catalyst layer has a larger thermal capacity than said subsidiary catalyst layer and said mixed gas generator, and
said heating means, said subsidiary catalyst layer, said main catalyst layer, and said exhaust openings are disposed along a flow of premixed gas in that order; and
said main catalyst layer and said subsidiary catalyst layer define a gap along said flow of premixed gas, said gap, said main catalyst layer, and said subsidiary catalyst layer being so arranged that a thickness of said main catalyst layer is used substantially for strong catalytic burning and a thickness of said subsidiary catalyst layer is used substantially for weak catalytic burning.

5. A catalytic burning apparatus comprising:
a mixed gas generator for mixing fuel with air,
an air blow fan,
a subsidiary catalyst layer for catalytic burning,
a main catalyst layer for catalytic burning,
a deodorizing catalyst layer for removing offensive smell,
exhaust openings, and
a heating means for preheating the subsidiary catalyst layer,
wherein said main catalyst layer has a larger thermal capacity than said subsidiary catalyst layer and said mixed gas generator, and
said heating means, said subsidiary catalyst layer, said main catalyst layer, said deodorizing catalyst layer, and said exhaust openings are disposed along a flow of premixed gas in that order; and
said main catalyst layer and said subsidiary catalyst layer define a gap along said flow of premixed gas, said gap, said main catalyst layer, and said subsidiary catalyst layer being so arranged that a thickness of said main catalyst layer is used substantially for strong catalytic burning and a thickness of said subsidiary catalyst layer is used substantially for weak catalytic burning.

6. A catalytic burning apparatus as claimed in claim 1, wherein said main catalyst layer and said subsidiary catalyst layer have thicknesses of 15–25 mm and 2–4 mm, respectively, and said gap is less than or equal to 20 mm at when said flow of premixed gases contains 2 to 3 times the amount of air necessary for stoichiometric combustion.

7. A catalytic burning apparatus as claimed in claim 2, wherein said main catalyst layer and said subsidiary catalyst layer have thicknesses of 15–25 mm and 2–mm, respectively, and said gap is less than or equal to 20 mm at when said flow of premixed gases contains 2 to 3 times the amount of air necessary for stoichiometric combustion.

8. A catalytic burning apparatus as claimed in claim 3, wherein said main catalyst layer and said subsidiary catalyst layer have thicknesses of 15–25 mm and 2–4 mm, respectively, and said gap is less than or equal to 20 mm at when said flow of premixed gases contains 2 to 3 times the amount of air necessary for stoichiometric combustion.

9. A catalytic burning apparatus as claimed in claim 4, wherein said main catalyst layer and said subsidiary catalyst layer have thicknesses of 15–25 mm and 2–4 mm, respectively, and said gap is less than or equal to 20 mm at when said flow of premixed gases contains 2 to 3 times the amount of air necessary for stoichiometric combustion.

10. A catalytic burning apparatus as claimed in claim 5, wherein said main catalyst layer and said subsidiary catalyst layer have thicknesses of 15–25 mm and 2–4 mm, respectively, and said gap is less than or equal to 20 mm at when said flow of premixed gases contains 2 to 3 times the amount of air necessary for stoichiometric combustion.

11. A catalytic burning apparatus as claimed in claim 1 wherein said subsidiary catalyst layer is substantially comprised of an inorganic fiber.

12. A catalytic burning apparatus as claimed in claim 2 wherein said subsidiary catalyst layer is substantially comprised of an inorganic fiber.

13. A catalytic burning apparatus as claimed in claim 3 wherein said subsidiary catalyst layer is substantially comprised of an inorganic fiber.

14. A catalytic burning apparatus as claimed in claim 4 wherein said subsidiary catalyst layer is substantially comprised of an inorganic fiber.

15. A catalytic burning apparatus as claimed in claim 5 wherein said subsidiary catalyst layer is substantially comprised of an inorganic fiber.

16. A catalytic burning apparatus as claimed in claim 6 wherein said subsidiary catalyst layer is substantially comprised of an inorganic fiber.

17. A catalytic burning apparatus as claimed in claim 7 wherein said subsidiary catalyst layer is substantially comprised of an inorganic fiber.

18. A catalytic burning apparatus as claimed in claim 8 wherein said subsidiary catalyst layer is substantially comprised of an inorganic fiber.

19. A catalytic burning apparatus as claimed in claim 9 wherein said subsidiary catalyst layer is substantially comprised of an inorganic fiber.

20. A catalytic burning apparatus as claimed in claim 10 wherein said subsidiary catalyst layer is substantially comprised of an inorganic fiber.

21. A catalytic burning apparatus as claimed in claim 1 wherein said subsidiary catalyst layer has a porosity of 50–80 percent.

22. A catalytic burning apparatus as claimed in claim 2 wherein said subsidiary catalyst layer has a porosity of 50–80 percent.

23. A catalytic burning apparatus as claimed in claim 3 wherein said subsidiary catalyst layer has a porosity of 50–80 percent.

24. A catalytic burning apparatus as claimed in claim 4 wherein said subsidiary catalyst layer has a porosity of 50–80 percent.

25. A catalytic burning apparatus as claimed in claim 5 wherein said subsidiary catalyst layer has a porosity of 50–80 percent.

26. A catalytic burning apparatus as claimed in claim 6 wherein said subsidiary catalyst layer has a porosity of 50–80 percent.

27. A catalytic burning apparatus as claimed in claim 7 wherein said subsidiary catalyst layer has a porosity of 50–80 percent.

28. A catalytic burning apparatus as claimed in claim 8 wherein said subsidiary catalyst layer has a porosity of 50–80 percent.

29. A catalytic burning apparatus as claimed in claim 9 wherein said subsidiary catalyst layer has a porosity of 50–80 percent.

30. A catalytic burning apparatus as claimed in claim 11 wherein said subsidiary catalyst layer has a porosity of 50–80 percent.

31. A method of catalytic burning which comprises the steps of:

providing a catalytic burning apparatus comprising a subsidiary catalyst layer and a main catalyst layer having a thermal capacity greater than that of said subsidiary catalyst downstream of said subsidiary catalyst layer with respect to a flow of premixed gas wherein said main catalyst layer and said subsidiary catalyst layer define a gap along the flow of premixed gas, preheating said subsidiary catalyst layer, blowing a premixed gas across said subsidiary catalyst layer to cause weak catalytic burning on the subsidiary catalyst layer, and increasing the blowing speed of the premixed gas to cause catalytic burning on said main catalyst layer.

32. A method of catalytic burning for regulating room temperature which comprises the steps of:

providing a catalytic burning apparatus comprising a subsidiary catalyst layer and a main catalyst layer having a thermal capacity greater than that of said subsidiary catalyst layer downstream of said subsidiary catalyst layer with respect to a flow of premixed gas wherein said main catalyst layer and said subsidiary catalyst layer define a gap along the flow of premixed gas, starting catalytic burning, and thereafter selectively regulating said room temperature by decreasing the blowing speed of premixed gas to cause weak catalytic burning on said subsidiary catalyst layer in order to decrease said room temperature and, increasing the blowing speed of premixed gas to cause strong catalytic burning on said main catalyst layer in order to increase said room temperature.

* * * * *